US010822870B2

(12) United States Patent
Chen

(10) Patent No.: US 10,822,870 B2
(45) Date of Patent: Nov. 3, 2020

(54) DETACHABLE CORD ROLLING DEVICE FOR NON-PULL CORD WINDOW BLIND

(71) Applicant: Po-Yu Chen, Taichung (TW)

(72) Inventor: Po-Yu Chen, Taichung (TW)

(73) Assignee: Jumbo Home Deco. Corporation, Cayman Islands (KY)

( * ) Notice: Subject to any disclaimer, the term of this patent is extended or adjusted under 35 U.S.C. 154(b) by 336 days.

(21) Appl. No.: 15/892,718

(22) Filed: Feb. 9, 2018

(65) Prior Publication Data

US 2019/0162016 A1 May 30, 2019

(30) Foreign Application Priority Data

Nov. 27, 2017 (TW) ..... 106141220 A

(51) Int. Cl.

| | |
|---|---|
| ***E06B 9/322*** | (2006.01) |
| *B65H 79/00* | (2006.01) |
| *B65H 75/34* | (2006.01) |

(52) U.S. Cl.

CPC ..... *E06B 9/322* (2013.01); *B65H 75/34* (2013.01); *B65H 79/00* (2013.01); *E06B 2009/3222* (2013.01); *E06B 2009/3225* (2013.01)

(58) Field of Classification Search

CPC ..... E06B 9/322; E06B 2009/3222; E06B 2009/3225; E06B 9/60; F03G 1/00; F03G 1/06; B65H 79/00; B65H 75/34

See application file for complete search history.

(56) References Cited

U.S. PATENT DOCUMENTS

| | | | | |
|---|---|---|---|---|
| 1,298,716 | A * | 4/1919 | Hoover | F03G 1/00 185/45 |
| 6,536,503 | B1 * | 3/2003 | Anderson | E06B 9/262 160/170 |
| 8,087,445 | B2 * | 1/2012 | DeWard | E06B 9/322 160/170 |
| 9,272,875 | B2 * | 3/2016 | Lin | B65H 57/00 |
| 9,574,396 | B2 * | 2/2017 | Toti | E06B 9/322 |
| 10,435,945 | B2 * | 10/2019 | Buccola, Jr. | E06B 9/34 |
| 2008/0289777 | A1 * | 11/2008 | Costello | B60J 1/2033 160/317 |
| 2012/0032019 | A1 * | 2/2012 | Chen | E06B 9/322 242/378 |
| 2017/0204656 | A1 * | 7/2017 | Chen | E06B 9/322 |
| 2017/0211321 | A1 * | 7/2017 | Chen | E06B 9/262 |

(Continued)

*Primary Examiner* — Katherine W Mitchell
*Assistant Examiner* — Abe Massad
(74) *Attorney, Agent, or Firm* — Rosenberg, Klein & Lee

(57) ABSTRACT

A detachable cord rolling device includes a cord rolling unit and an auxiliary driving unit. The cord rolling unit has a first base where first and second torsion spring gears engaged with each other are disposed. A first torsion spring is disposed between the first and second torsion spring gears. The auxiliary driving unit has a second base where third and fourth torsion spring gears engaged with each other are disposed. The second base is detachably disposed on the first base of the cord rolling unit. The third torsion spring gear and the first torsion spring gear of the cord rolling unit are connected by a transmission shaft, thereby rotatable synchronously. As a result, the cord rolling unit of the invention can be used individually, or combined with the auxiliary driving unit by the transmission shaft for increasing the rolling force of the cord rolling unit.

4 Claims, 5 Drawing Sheets

(56) References Cited

U.S. PATENT DOCUMENTS

| | | | | |
|---|---|---|---|---|
| 2019/0162278 | A1* | 5/2019 | Chen | E06B 9/322 |
| 2019/0211624 | A1* | 7/2019 | Lei | A47H 5/02 |
| 2019/0292845 | A1* | 9/2019 | Chen | E06B 9/322 |

* cited by examiner

DETACHABLE CORD ROLLING DEVICE FOR NON-PULL CORD WINDOW BLIND

BACKGROUND OF THE INVENTION

1. Field of the Invention

The present invention relates to non-pull cord window blinds and more particularly, to a detachable cord rolling device for the non-pull cord window blind.

2. Description of the Related Art

As to the non-pull cord window blind, the lift transmission cord is rolled up by the cord rolling device disposed in the top beam. Because the lift transmission cord is tied to the bottom beam, the bottom beam is gradually moved up relative to the top beam during the process that the lift transmission cord is rolled up, so that the slats of the window blind are folded up by the upwardly moving bottom beam.

The aforesaid cord rolling device is workable for normal-sized window blind. However, for the large-sized window blind, the pulling force provided by the aforesaid cord rolling device may be too small to move up the bottom beam successfully. At present, the method to solve the aforesaid problem is to use two or more than two cord rolling devices, but the increase of the number of components certainly increases the cost and the structural complication.

SUMMARY OF THE INVENTION

It is a primary objective of the present invention to provide a detachable cord rolling device for the non-pull cord window blind, which has the characteristics of convenient operation, cost lowering, and structure simplifying.

To attain the above objective, the present invention provides a detachable cord rolling device which includes a cord rolling unit, an auxiliary driving unit, and a transmission shaft. The cord rolling unit has a first base, a first torsion spring gear, a second torsion spring gear, a first torsion spring, a cord rolling gear, and a lift transmission cord. The first and second torsion spring gears are rotatably disposed on the first base and engaged with each other. The first torsion spring connects the first and second torsion spring gears. The cord rolling gear is rotatably disposed on the first base and engaged with one of the first and second torsion spring gears. The lift transmission cord is wound around the cord rolling gear. The auxiliary driving unit has a second base, a third torsion spring gear, a fourth torsion spring gear, and a second torsion spring. The second base is detachably disposed on a top surface of the first base of the cord rolling unit. The third and fourth torsion spring gears are rotatably disposed on the second base and engaged with each other. The second torsion spring connects the third and fourth torsion spring gears. The transmission shaft detachably connects the first torsion spring gear of the cord rolling unit and the third torsion spring gear of the auxiliary driving unit, thereby enabling the first and third torsion spring gears to rotate synchronously.

It can be understood from the above illustration that the cord rolling unit of the detachable cord rolling device of the invention is workable individually. Besides, the auxiliary driving unit can be installed on the cord rolling unit by the transmission shaft. Through the cooperation of the first and second torsion springs, the detachable cord rolling device of the present invention have enough rolling force to work for the large-sized window blind, so the window blind doesn't need the additionally increased cord rolling unit, thereby lowered in cost and simplified in structure.

DETAILED DESCRIPTION OF THE INVENTION

Figure 1:
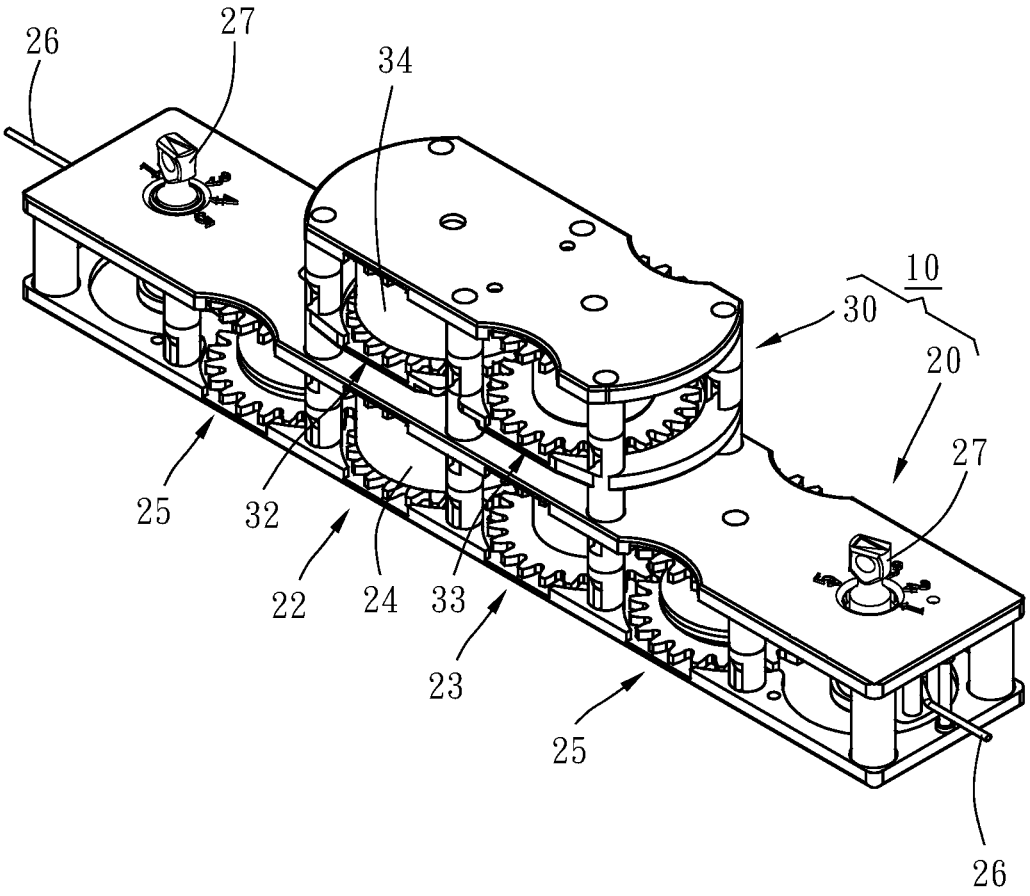
FIG. 1 is an assembled perspective view of a detachable cord rolling device according to a first preferred embodiment of the present invention.
Figure 2:
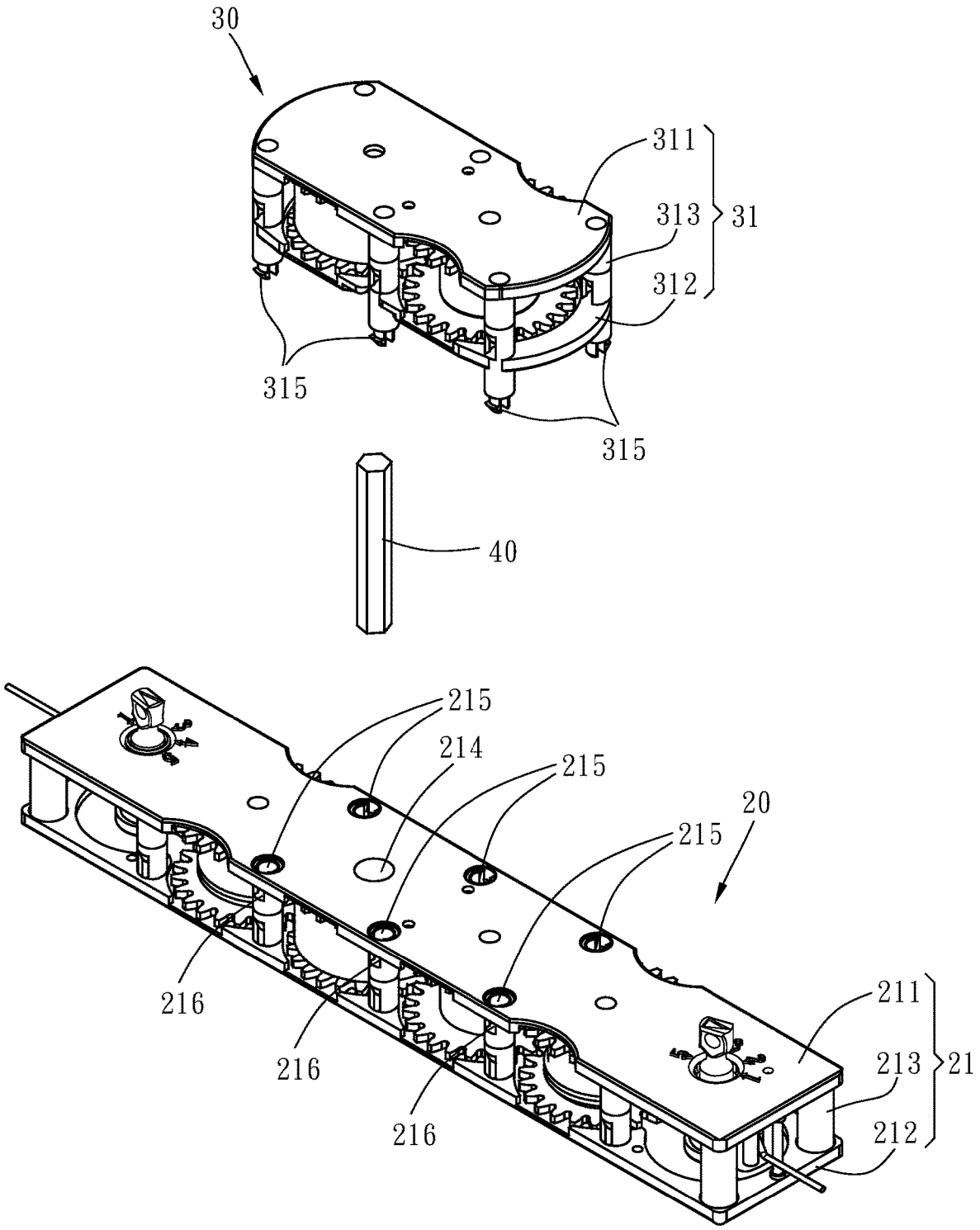
FIG. 2 is a partially exploded perspective view of the detachable cord rolling device according to the first preferred embodiment of the present invention.

Referring to FIGS. 1-2, a detachable cord rolling device 10 according to a first preferred embodiment of the present invention includes a cord rolling unit 20, an auxiliary driving unit 30, and a transmission shaft 40.

The cord rolling unit 20 is disposed in a top beam (not shown), and has a first base 21, a first torsion spring gear 22, a second torsion spring gear 23, a first torsion spring 24, two cord rolling gears 25, two lift transmission cords 26, and two brakes 27.

Figure 3:
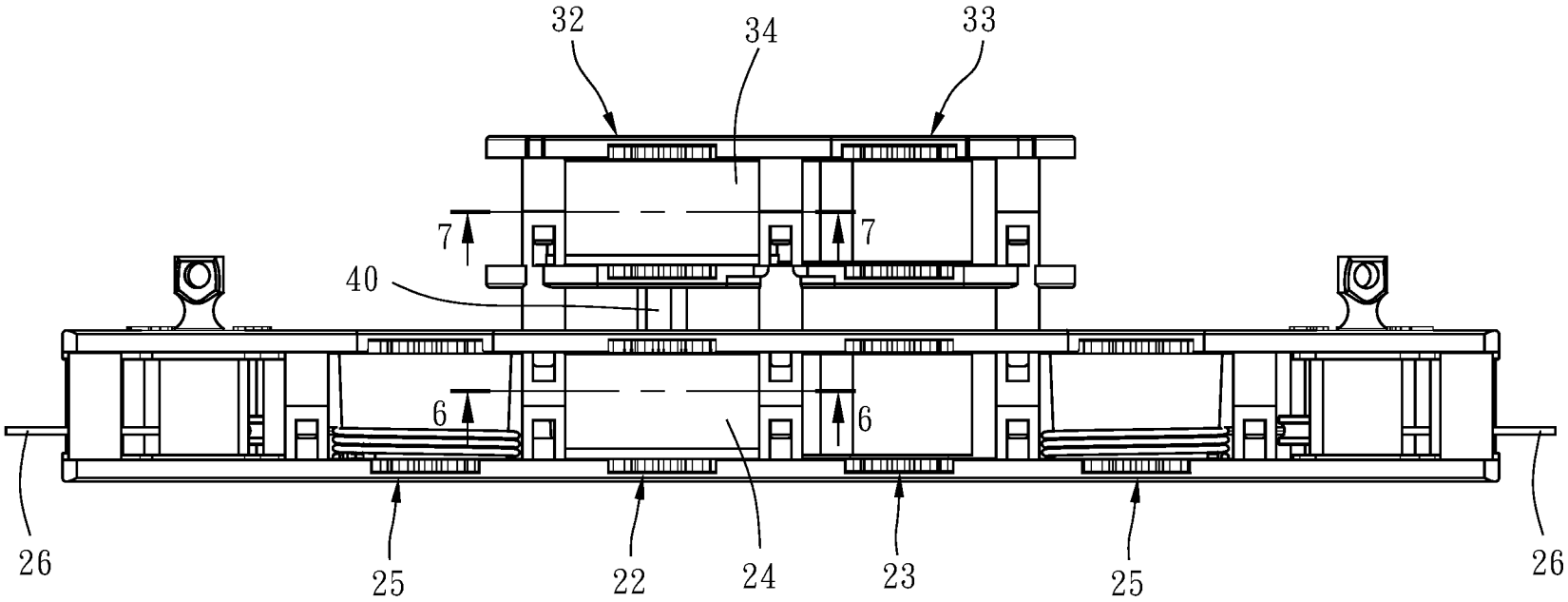
FIG. 3 is a front view of the detachable cord rolling device according to the first preferred embodiment of the present invention.

As shown in FIGS. 2-3, the first base 21 has a first top plate 211 and a first bottom plate 212. The first top and bottom plates 211 and 212 are connected by a plurality of first supporting posts 213. The first top plate 211 is provided on the top surface thereof with a top hole 214 and six through holes 215. Each through hole 215 corresponds to a first supporting post 213. Each of the aforesaid first supporting posts 213 has a hook groove 216 communicating with the through hole 215.

Figure 5:
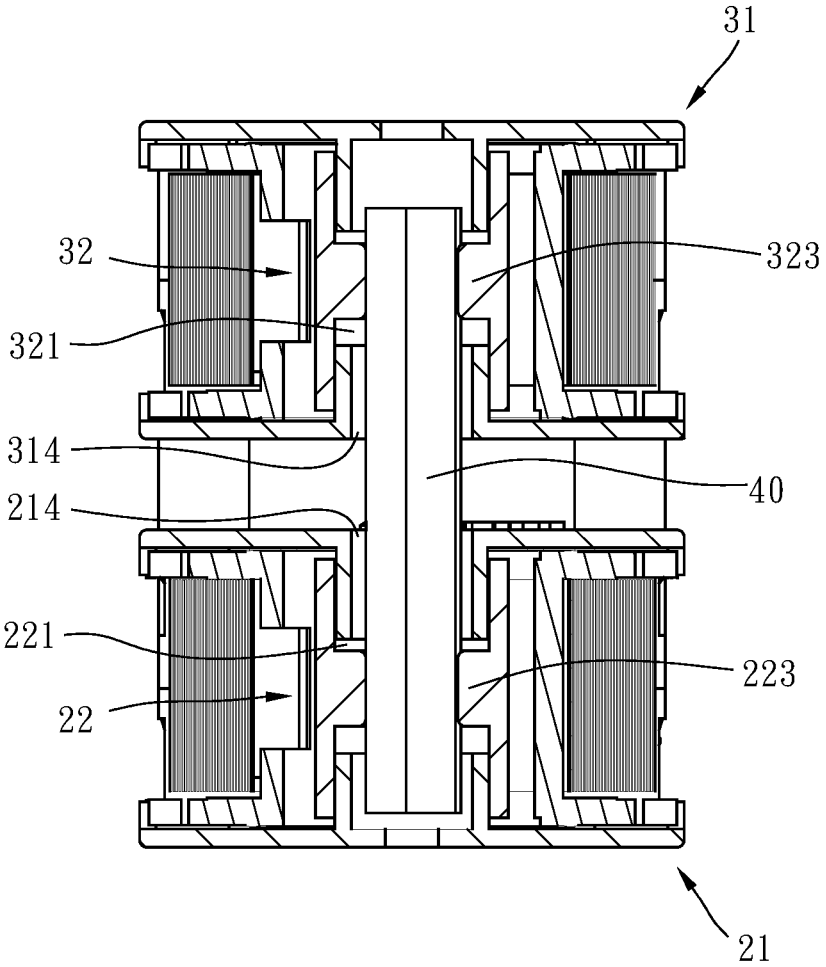
FIG. 5 is a sectional view of the detachable cord rolling device according to the first preferred embodiment of the present invention, primarily showing a transmission shaft connects first and third torsion spring gears.
Figure 6:
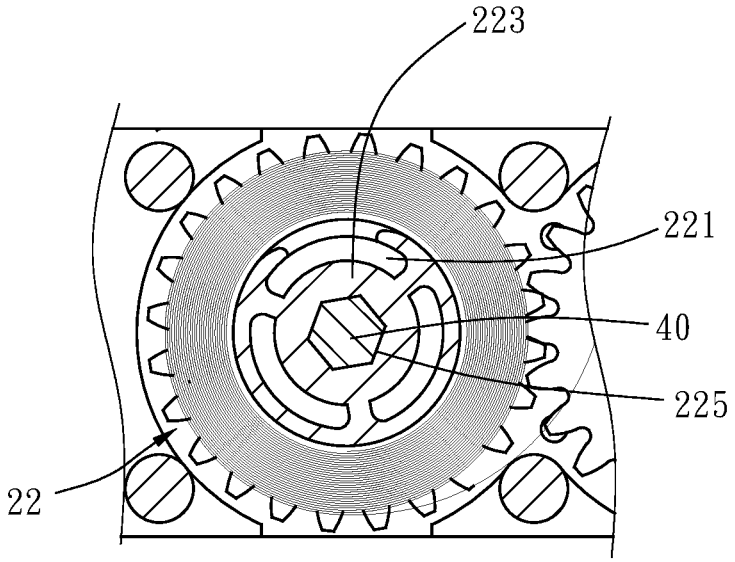
FIG. 6 is a sectional view taken along the line 6-6 in FIG. 3.

As shown in FIGS. 2-3, the first and second torsion spring gears 22 and 23 are rotatably disposed on the first base 21 and engaged with each other, so that the first and second torsion spring gears 22 and 23 are rotatable synchronously. As shown in FIGS. 5-6, the first torsion spring gear 22 has a first axial hole 221 which correspondingly communicates with the top hole 214 of the first base 21. The first axial hole 221 is provided on the inner wall thereof with a first engaging portion 223 which is provided with a first polygonal hole 225, such as the hexagonal hole shown in FIG. 6.

As shown in FIGS. 1 and 3, the first torsion spring 24 connects the first and second torsion spring gears 22 and 23 for providing resilient force to drive the first and second torsion spring gears 22 and 23.

As shown in FIGS. 1 and 3, the two cord rolling gears 25 are rotatably disposed on the first base 21 and engaged with the first and second torsion spring gears 22 and 23 respectively, so that the two cord rolling gears 25 can be driven by the first and second torsion spring gears 22 and 23 respectively.

As shown in FIGS. 1 and 3, an end of the two lift transmission cords 26 are attached to the two cord rolling gears 25 respectively. The other end of the two lift transmission cords 26 are both attached to a bottom beam (not shown).

As shown in FIG. 1, the two brakes 27 are disposed at two ends of the first base 21 for providing appropriate friction to the lift transmission cords 26 respectively. The brakes 27 are only auxiliary for the illustration of the invention, not the necessary member of the invention, thereby able to be arbitrarily modified in structure. The detachable cord rolling device 10 may even have no such brake 27.

The auxiliary driving unit 30 has a second base 31, a third torsion spring gear 32, a fourth torsion spring gear 33, and a second torsion spring 34.

Figure 4:
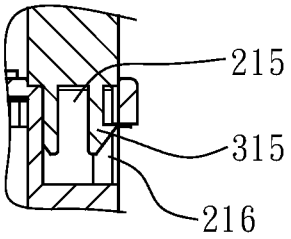
FIG. 4 is a sectional view of a part of the detachable cord rolling device according to the first preferred embodiment of the present invention, primarily showing a hook portion of a second base is hooked in a hook groove of a first base.

As shown in FIGS. 2-5, the second base 31 has a second top plate 311 and a second bottom plate 312. The second top and bottom plates 311 and 312 are connected by a plurality of second supporting posts 313. The second bottom plate 312 is provided on the bottom surface thereof with a bottom hole 314, as shown in FIG. 5. The bottom hole 314 corresponds to the top hole 214 of the first top plate 211 of the first base 21. Besides, as shown in FIG. 2, the second bottom plate 312 is provided on the bottom surface thereof with six hook portions 315. All the hook portions 315 correspond to the through holes 215 of the first top plate 211 of the first base 21 one on one. In this way, as shown in FIG. 4, the first and second bases 21 and 31 can be combined together in a way that the hook portions 315 of the second base 31 are inserted in the through holes 215 of the first base 21 and then hooked in the hook grooves 216 of the first base 21. However, the first and second bases 21 and 31 can be separated by relief of the hook relation between the hook portions 315 and the hook grooves 216.

Figure 7:
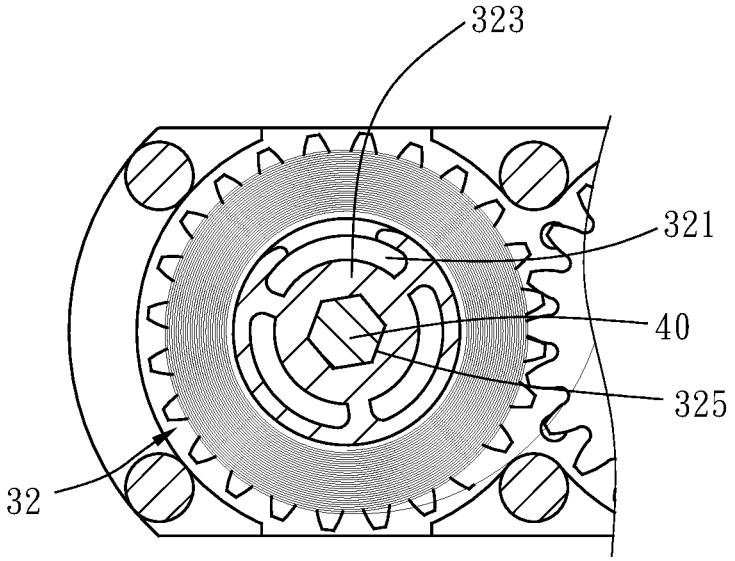
FIG. 7 is a sectional view taken along the line 7-7 in FIG. 3.

As shown in FIGS. 1-3, the third and fourth torsion spring gears 32 and 33 are rotatably disposed on the second base 31 and engaged with each other, so that the third and fourth torsion spring gears 32 and 33 are rotatable synchronously. As shown in FIGS. 5 and 7, the third torsion spring gear 32 has a third axial hole 321 which correspondingly communicates with the bottom hole 314 of the second bottom plate 312 of the second base 31. The third axial hole 321 is provided on the inner wall thereof with a third engaging portion 323 which is provided with a third polygonal hole 325, such as the hexagonal hole shown in FIG. 7.

As shown in FIGS. 1 and 3, the second torsion spring 34 connects the third and fourth torsion spring gears 32 and 33 for providing resilient force to drive the third and fourth torsion spring gears 32 and 33.

As shown in FIGS. 2, 3 and 5, the transmission shaft 40 is hexagon-shaped in sections thereof. The top end of the transmission shaft 40 is inserted through the bottom hole 314 of the second base 31 and inserted in the third polygonal hole 325 of the third engaging portion 323 of the third torsion spring gear 32, thereby engaged there, as shown in FIG. 7. The bottom end of the transmission shaft 40 is inserted through the top hole 214 of the first base 21 and inserted in the first polygonal hole 225 of the first engaging portion 223 of the first torsion spring gear 22, thereby engaged there, as shown in FIG. 6. Because the transmission shaft 40 and the first and third polygonal holes 225 and 325 are polygon-shaped in sections thereof, the first torsion spring gear 22 can drive the third torsion spring gear 32 to rotate together through the transmission shaft 40. At this time, the third torsion spring gear 32 can further drive the fourth torsion spring gear 33.

It can be understood from the above illustration that in the condition that the cord rolling unit 20 is used individually, when the two lift transmission cords 26 are pulled out to gradually escape from the two cord rolling gears 25, the two cord rolling gears 25 drives the first and second torsion spring gears 22 and 23 respectively, so that the first torsion spring 24 is stretched by the first and second torsion spring gears 22 and 23, and the resilient force of the first torsion spring 24 is saved. In opposite, when the resilient force of the first torsion spring 24 is applied to the first and second torsion spring gears 22 and 23, the first and second torsion spring gears 22 and 23 drive the two cord rolling gears 25 respectively, so that the two cord rolling gears 25 roll up the associated lift transmission cords 26 respectively.

In the condition that the cord rolling unit 20 is used with the auxiliary driving unit 30 cooperatively, when the first torsion spring gear 22 is driven by the cord rolling gear 25 engaged with it, the first torsion spring gear 22 drives the third torsion spring gear 32 to rotate together through the transmission shaft 40, and then the third torsion spring gear 32 further drives the fourth torsion spring gear 33, so that the second torsion spring 34 is stretched by the third and fourth torsion spring gears 32 and 33, and the resilient force of the second torsion spring 34 is saved. When the resilient force of the first torsion spring 24 is applied to the first torsion spring gear 22, the first torsion spring gear 22 also drives the third torsion spring gear 32 to rotate reversely through the transmission shaft 40, so that the stretching force applied by the third and fourth torsion spring gears 32 and 33 to the second torsion spring 34 is relieved. At this time, the resilient force of the second torsion spring 34 auxiliarily drives the third and fourth torsion spring gears 32 and 33 to rotate reversely to the original state.

In conclusion, for the detachable cord rolling device 10 of the present invention, the auxiliary driving unit 30 can be installed or removed, depending on the practical demands. Therefore, the cord rolling unit 20 can be used individually, or operated with the auxiliary driving unit 30 together. Through the cooperation of the first and second torsion springs 24 and 34 and the transmission of the transmission shaft 40, the detachable cord rolling device 10 of the invention has enough rolling force to work for the large-sized window blind, so the window blind doesn't need the additionally increased cord rolling unit 20, thereby lowered in cost and simplified in structure. Besides, the first and second torsion springs 24 and 34 may be the same or different in specification, so that the resilient force thereof may be equal or unequal, that can be modified according to practical demands. In this way, the structural arrangement is more selective and elastic.

What is claimed is:

1. A detachable cord rolling device for a non-pull cord window blind, the detachable cord rolling device comprising:

a cord rolling unit having a first base, a first torsion spring gear, a second torsion spring gear, a first torsion spring, at least one cord rolling gear and at least one lift transmission cord, the first and second torsion spring gears being rotatably disposed on the first base and engaged with each other, the first torsion spring connecting the first and second torsion spring gears, the at least one cord rolling gear being rotatably disposed on the first base and engaged with one of the first and second torsion spring gears, the at least one lift transmission cord being wound around the at least one cord rolling gear;

an auxiliary driving unit having a second base, a third torsion spring gear, a fourth torsion spring gear and a second torsion spring, the second base being detachably disposed on a top surface of the first base of the cord rolling unit, the third and fourth torsion spring gears being rotatably disposed on the second base and engaged with each other, the second torsion spring connecting the third and fourth torsion spring gears; and a transmission shaft detachably connecting the first torsion spring gear of the cord rolling unit and the third torsion spring gear of the auxiliary driving unit, thereby enabling the first and third torsion spring gears to rotate synchronously.

2. The detachable cord rolling device as claimed in claim 1, wherein:

the first torsion spring gear has a first engaging portion provided with a first polygonal hole;

the third torsion spring gear has a third engaging portion provided with a third polygonal hole;

a top end of the transmission shaft is engaged with the third polygonal hole of the third engaging portion of the third torsion spring gear; and a bottom end of the transmission shaft is engaged with the first polygonal hole of the first engaging portion of the first torsion spring gear.

3. The detachable cord rolling device as claimed in claim 1, wherein:

the first base has a plurality of hook grooves;

the second base has a plurality of hook portions; and the hook portions are detachably hooked in the hook grooves of the first base respectively.

4. The detachable cord rolling device as claimed in claim 1, wherein:

the cord rolling unit includes at least two cord rolling gears, and at least two lift transmission cords;

the first and second torsion spring gears are engaged with two said cord rolling gears respectively; and two said lift transmission cords are wound around the two said cord rolling gears respectively.

* * * * *